US005372661A

United States Patent [19]

Felix et al.

[11] Patent Number: 5,372,661

[45] Date of Patent: Dec. 13, 1994

[54] ALLOYS OF MOLYBDENUM, RHENIUM AND TUNGSTEN

[75] Inventors: Vinci M. Felix, Kennett Square, Pa.; Yong J. Park, Brossard, Canada

[73] Assignee: E. I. Du Pont de Nemours and Company, Wilmington, Del.

[21] Appl. No.: 87,947

[22] Filed: Jul. 6, 1993

Related U.S. Application Data

[63] Continuation of Ser. No. 837,442, Feb. 14, 1992, abandoned.

[51] Int. Cl.[5] ..... C22C 27/04

[52] U.S. Cl. ..... 148/423; 75/611; 75/623; 148/442; 420/429; 420/580

[58] Field of Search ..... 148/423, 442; 420/429, 420/580; 75/611, 623

[56] References Cited

U.S. PATENT DOCUMENTS

| | | | |
|---|---|---|---|
| 2,157,936 | 5/1939 | Hensel et al. | 420/432 |
| 3,328,626 | 6/1967 | Natter et al. | 420/429 |
| 3,375,109 | 3/1968 | Peters | 75/212 |
| 4,165,982 | 8/1979 | Tatsuo et al. | 420/429 |

FOREIGN PATENT DOCUMENTS

| | | | |
|---|---|---|---|
| 2212436 | 12/1929 | France . | |
| 60-33335 | 2/1985 | Japan | 420/429 |
| 591420 | 8/1947 | United Kingdom . | |
| 873837 | 7/1961 | United Kingdom . | |
| 165310 | 9/1964 | U.S.S.R. . | |

OTHER PUBLICATIONS

"Alloys of Tungsten and Molybdenum with Rhenium for Elastic Elements of Instruments", E. M. Savitskii, et al., Fourth All-Union Conference on Phase Diagrams of Metallic Systems, Translated from Metallovedenie i Termicheskaya Obrabotka Metallov, No. 2, pp. 46–48, 1984.

"Weldability Of Sintered Mo–Re Alloys"—Fumio Morito, National Research Institute for Metals, pp. 417–431.

"Solution Softening In Mo–Re Alloys"—L. B. Lundberg et al., Los Alamos National Laboratory, pp. 71–79, Physical Metallurgy of Molybdenum and Its Alloys, Proceedings of a Symposium Held at AMAX Materials Research Center, 1985.

"Properties Of Refractory Alloys Containing Rhenium"—Chester T. Sims et al., *Transactions of the ASM*, vol. 52 (1960), pp. 929–947.

"Ductility Studies On Sintered Tungsten–Molybdenum–Rhenium Alloys" W. H. Lenz et al.—Los Alamos Scientific Laboratory of the Univ. of California, pp. 3 to 12, 1969.

"The Rhenium Effect in Sintered Tungsten–Molybdenum–Base Alloys" W. H. Lenz et al.—Los Alamos Scientific Laboratory of the Univ. of California, pp. 1 to 13, 1969.

"High–Temperature Creep–Rupture Behavoir Of Some Tungsten–Rhenium–Molybdenum Alloys"—P. N. Flagella et al.—Nuclear Materials and Propulsion Operation, Nuclear Technology Dept., Nuclear Energy Div. GE pp. 1–24, 1967.

"The Workability And Mechanical Properties Of Tungsten–And Molybdenum–Base Alloys Containing Rhenium"—D. J. Maykuth et al.—Dept. of Metallurgy, Battelle Memorial Institute, Electrochemical Society Symposium on Rhenium, 1960, pp. 114–125.

*Primary Examiner*—Richard Dean
*Assistant Examiner*—Robert R. Koehler
*Attorney, Agent, or Firm*—Michael K. Boyer

[57] ABSTRACT

A molybdneum, rhenium, and tungsten alloy having an improved erosion, ductility, strength and a higher recrystallization temperature. The alloy may be fabricated into equipment which is useful for manufacturing chemicals such as a hydrochlorofluorocarbon.

7 Claims, 4 Drawing Sheets

LONGITUDINAL

LONGITUDINAL

TRANSVERSE

LONGITUDINAL

TRANSVERSE

LONGITUDINAL

TRANSVERSE

LONGITUDINAL

TRANSVERSE

ALLOYS OF MOLYBDENUM, RHENIUM AND TUNGSTEN

This is a continuation of application Ser. No. 07/837,442 filed Feb. 14, 1992, now abandoned.

FIELD OF THE INVENTION

This invention relates to molybdenum alloys which possess improved tensile strength and a higher recrystallization temperature while maintaining an adequate level of ductility and corrosion resistance.

BACKGROUND OF THE INVENTION

Molybdenum metal is used for various specialty applications which require its unusual properties. The melting point of molybdenum is 2630° C., over 1000° C. higher than iron, permitting its use in furnace parts, rocket nozzles and other high-temperature applications where most metals would melt or fail. Molybdenum has exceptionally good resistance to corrosion by mineral acids under non-oxidizing conditions.

However, because of its high melting point and poor ductility, molybdenum requires special manufacturing techniques.

A molybdenum part having acceptable mechanical properties typically depends on working the metal below its recrystallization temperature. When recrystallization is allowed to occur, the molybdenum has a tendency toward brittleness at lower temperatures (e.g., near room temperature and below). Recrystallization becomes particularly difficult to avoid if the manufacturing process requires brazing or welding, since recrystallization may easily occur at the brazing or welding site. Should recrystallization occur, the weld must subsequently be warm-worked to improve ductility. This tendency of recrystallized molybdenum to be brittle is one of the major deterrents to its use in many applications.

SUMMARY OF THE INVENTION

The invention is directed to an alloy comprising molybdenum, rhenium and tungsten which possess improved erosion resistance, tensile strength and a higher recrystallization temperature, while maintaining an adequate level of ductility and corrosion resistance.

The invention relates broadly to improving the properties of a molybdenum alloy comprising from about 10 wt. % through about 41 wt. % rhenium. In a specific aspect of the invention the alloy comprises about 77% molybdenum, 13% rhenium, and 10% tungsten by weight, and about 50 to 100 ppm of carbon. When converted into atomic %, this alloy corresponds to about 86.6% molybdenum, 7.5% rhenium and 5.9% tungsten. This alloy possesses an approximately 10% higher tensile strength and an 80° C. higher recrystallization temperature than a Mo-13 wt. % Re alloy.

The alloys of the invention may be prepared by powder metallurgy, followed by sintering and densification. Densification may be achieved by at least one of the following techniques: an electric current, a hydrogen atmosphere muffle furnace, arc-casting using consumable electrode melting under a vacuum, and others. The dense alloy may be shaped or worked for obtaining a part such as a pipe, thermowell, rod, sheet, wire, and others. The shaped articles may be further processed for providing equipment to be used in chemical manufacture. For example, the shaped articles may be further processed by brazing, drawing, explosive cladding, stamping, welding, and others.

DETAILED DESCRIPTION OF THE INVENTION

Figure 1A:
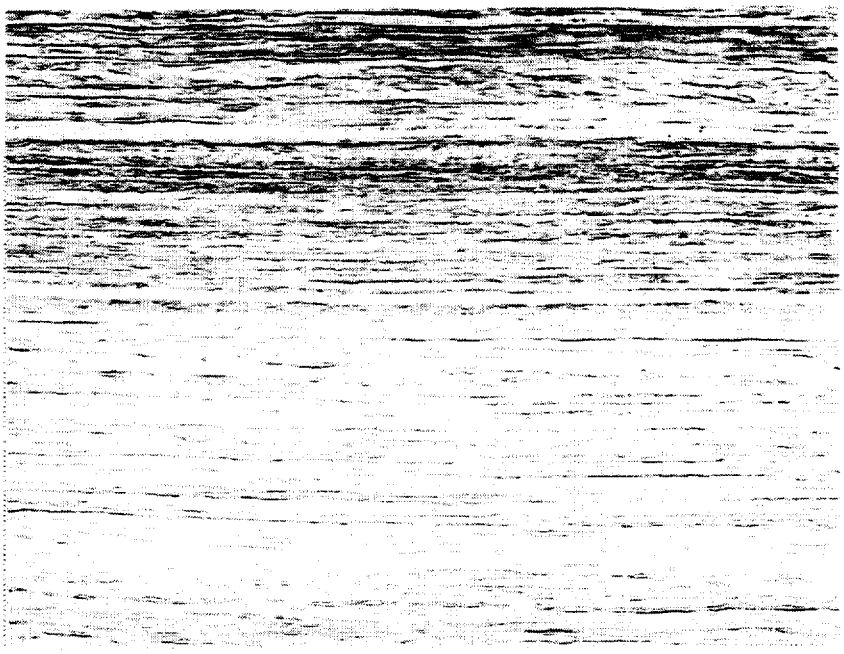
FIG. 1—FIGS. 1(*a*) and (*b*) are photo-micrographs at 200× magnification, respectively, along the longitudinal and transverse directions of a rolled Mo-13% Re-high C alloy sheet produced in accordance with the Example.

This invention is directed to alloys comprising molybdenum, rhenium and tungsten which possess improved erosion resistance, ductility, tensile strength and a higher recrystallization temperature. These desirable properties of the alloy permit fabricating or shaping the alloy into a virtually unlimited array of parts. For example, the alloys of the invention may be shaped into parts such as sheets, pipes, rods, wires, and others. The physical properties (e.g., ductility, recrystallization temperature) of the alloy are desirable in that the shaped parts may be further processed by being brazed, drawn, welded, machined, explosively dad or bonded onto other materials, stamped, and others. Further, the chemical properties of the alloy are sufficient to permit the alloy to be used in high-temperature environments which are corrosive and/or erosive.

The alloys of this invention may be prepared by any suitable technique such as blending and alloying molybdenum, tungsten and rhenium powders, which contain carbon and oxygen. The powders are blended in proportions which will provide an improved molybdenum alloy broadly comprising about 10–41 wt % rhenium. In a particular aspect of the invention, the alloy comprises about 75.5 to 78.5 wt. %, preferably about 77 wt. % (86.6 atomic %) molybdenum; about 12.5 to 13.5 wt. %, preferably about 13 wt. % (7.5 atomic %) rhenium; about 9.0 to 11.0 wt. %, preferably about 10 wt. % (5.9 atomic %) tungsten; and, about 50 to 100 ppm, preferably 75 ppm carbon.

The particle size of the components being alloyed is not critical for effectively practicing the invention. For best results, the particle size of the alloying components ranges from about 2 microns through about minus 325 mesh. The powders may be blended in any acceptable manner which does not significantly contaminate the powders. The powders may be processed by using any suitable technique which provides an alloy having the properties discussed above. Suitable techniques for obtaining the alloy comprise at least one of arc-casting, electrode melting under vacuum, and others. Regardless of the technique selected, the components should be alloyed in a manner which reduces the liklihood of being contaminated by oxygen (e.g., processing the alloying components in a dry hydrogen environment).

A deoxidant such as boron, carbon and others, may be added to the components of the alloy before forming or casting the resultant alloy. The appropriate amount of deoxidant is determined and, if necessary, an additional quantity of deoxidant is introduced to the components before forming the alloy. In accordance with the invention, a "deoxidant" functions to prevent, if not eliminate, formation of metal oxides. Without wishing to be bound by any theory or explanation, it is believed that excess oxygen in the components of the alloy may lead to the formation of metal oxides. The metal oxides tend to migrate to the grain boundaries of the alloy and lead to poor ductility. For example, alloys of the invention which include less than about 50 ppm of carbon in the alloy components tend to be relatively brittle.

The rhenium component of the alloy improves the ability of the molybdenum alloy to be shaped or worked. The relatively small atomic size of rhenium permits this component to become dissolved in the molybdenum, thereby causing a phenomenon known as "solution softening". A quantity of rhenium below about 10 wt. % will not show sufficient softening of the molybdenum to permit maximum workability whereas a quantity of rhenium of greater than about 41 wt. % is prohibitively expensive.

Tungsten is included as a component of the alloy to provide improved erosion resistance to the alloy. The preferred quantity of tungsten ranges from about 7 wt. % through about 15 wt. %. The tungsten component serves to increase the hardness and impact resistance of the alloy, thereby rendering the alloy more resistant to wear. As a result, the alloy of the invention may be fabricated into equipment which can be exposed to high-temperature environments that are corrosive and erosive (e.g., a chemical reactor for producing a hydrochlorofluorocarbon). Moreover, the corrosion and erosion resistance of the alloy reduces, if not eliminates, contamination of a chemical manufacturing process caused by release of corrosion/erosion by-products. For example, should a chemical process be conducted in equipment which is not adequately corrosion/erosion resistant, the equipment may degrade thereby releasing contaminants into the process. These contaminants may reduce reaction rates, become involved in unintended reactions, inhibit catalytic activity, and others.

Tungsten is also added as a component of the alloy for increasing the recrystallization temperature of the alloy. It was a surprising discovery that the recrystallization temperature of a molybdenum/rhenium alloy may be raised at least about 80° C. (i.e., 80° through 100° C.), by including tungsten as a component of the alloy. The increased recrystallization temperature permits the alloy of the present invention to be more readily machined, welded, brazed, and others, to fabricate structural parts. These parts are particularly desirable for use in high-temperature environments that are corrosive and erosive. For example, the alloy may be fabricated into various types of equipment (e.g., an agitator, a reaction vessel, piping, valves), which can be used in connection with manufacturing chemicals such as hydrochlorofluorocarbons. Further, the alloys of the invention may be explosively clad, brazed, welded, and others, with a variety of materials heretofor unacceptable for use in conjunction with molybdenum. In one aspect of the invention, the alloy may be brazed with gold, a gold-copper alloy, gold-nickel alloy, and others.

In the present invention "recrystallization temperature" is defined as the temperature at which existing grains within the alloy are at least partially replaced by newly grown grains. For example, when an alloy is heated above the recrystallization temperature, certain grains will preferentially grow or recrystallize, at the expense of neighboring grains, thereby increasing the average size of the grains in the alloy. The preferential grain growth may also occur at temperatures which are lower than the recrystallization temperature, but the growth rate is significantly slower.

A number of other factors in addition to time and temperature can effect the recrystallization temperature. The most important factors are (1) alloy composition, (2) initial grain size, and; (3) processing history of the metal or alloy. As a general rule, the recrystallization temperature equates to a high-percentage of the melting point of the particular alloy. Small grains in an alloy tend to grow or recrystallize at lower temperatures and a faster rate than relatively large grains. The processing history of an alloy is a factor which considers how the alloy was previously handled affects the recrystallization temperature. For example, an alloy which has been repeatedly heat-cycled, worked, and others, may recrystallize at a relatively low temperature.

The ductility of the present alloy may be improved by thermo-mechanically shaping or working (e.g., hot-rolling, stamping, and others). Shaping the alloy generally deforms a significant quantity of the grains in the alloy, thereby improving the ductility of the alloy. However, shaping the alloy at a temperature greater than the recrystallization temperature may result in grain growth or an increase in the average grain size which reduces the ductility and strength of the alloy. In this regard, the presence of tungsten in the present alloy increases the recrystallization temperature such that the alloy may be more readily shaped (e.g., to improve ductility), without danger of recrystallization.

Referring now to the Figures, the Figures illustrate that the sheets obtained from the alloy possess a fine grained (i.e., not recrystallized), and uniform microstructure. Particularly, the microstructure of an alloy sheet, along either the longitudinal or transverse rolling direction, is substantially uniform. However, the microstructures along the longitudinal and transverse directions may not be equivalent. The properties (e.g., tensile strength), of the rolled sheet may vary with the rolling direction and, thus, it may be desirable to ascertain the rolling direction of the sheet before performing further processing. For example, prior to explosively cladding the alloy sheet (e.g., onto carbon steel, stainless steel, and others), it is important to orient the sheet such that the shock wave from the explosion travels parallel to or along the grain in the sheet.

The properties of the alloy may be tailored before, during and/or after being fabricated into a particular article, to comply with the needs of certain end-use applications. For example, the alloy of the invention may be annealed, stress-relieved, tempered, and others. Moreover, while the high recrystallization temperature of the present alloy is desirable, the alloy is also capable of being recrystallized when required in its manufacture.

Parts or equipment fabricated from the alloy contain valuable and expensive metals which may be readily recovered (e.g., for recycling). As a result, an article which is fabricated from the alloy can be decommissioned in a cost-effective manner.

While particular emphasis in the above discussion was placed upon using the alloy in connection with equipment for manufacturing and transporting chemicals, the alloy of the invention is also desirable for use in nuclear and aerospace applications.

Certain aspects of the invention are demonstrated by the following Examples. The following Example demonstrates that the alloy of the invention can be produced and shaped on a commercial scale. It is to be understood that the following Examples are provided to illustrate, and not limit the scope of the invention.

Unless specified otherwise, the materials used in the following Examples are commercially available and substantially pure.

EXAMPLE

Three approximately 87 wt. % molybdenum-13% rhenium alloy and three 77 wt. % molybdenum-13% rhenium-10% tungsten alloy electrodes, weighing about 13 to 14 kg each, were prepared by blending −325 mesh molybdenum, 2–6 micron tungsten and −325 mesh rhenium powders with 100, 300 and 400 ppm of −200 mesh carbon powder (deoxidant), respectively. The blended powders contained approximately 1000 ppm of oxygen. The blended powders were cold isostatically compacted in rubber molds at a pressure of about 275 MPa (40 ksi) to form bar electrodes approximately 55 mm diameter by 600 mm long. The bar electrodes were then sintered in dry hydrogen. To sinter the electrodes, the electrodes were heated to and held for about 2 hours at about 1000° C., heated to about 1800° C. in about 8 hours, held at temperature for about 16 hours, heated to and held at about 1900° C., furnace cooled to about 1000° C., and then rapidly cooled to room temperature. Electrode diameters after sintering were close to 51 min.

Carbon and oxygen contents of the sintered electrodes were determined from samples taken from near the half-radius position of the top and bottom ends of each electrode. The average carbon and oxygen contents of each electrode are presented in Table 1.

TABLE 1

CARBON AND OXYGEN CONTENT OF THE ELECTRODES

| Electrode Number | Blended Composition | Carbon/Oxygen ppm | Carbon/Oxygen ppm |
|---|---|---|---|
| A | Mo-13% Re-100 ppm C | 6 | 52 |
| B | Mo-13% Re-10% W-100 ppm C | 12 | 43 |
| c | Mo-13% Re-400 ppm C | 80 | 21 |
| D | Mo-13% Re-10% W-400 ppm C | 110 | 14 |
| E | Mo-13% Re-300 ppm C | 54 | 26 |
| F | Mo-13% Re-10% W-300 ppm C | 53 | 24 |

The sintered electrodes were melted in a Heraeus brand vacuum arc-melting furnace using a tapered water-cooled copper mold having a mean diameter of about 90 mm. Using standard arc-melting procedures, a molybdenum disc (stool), about 80 mm diameter by about 25 mm thick, was placed at the bottom of the copper mold and covered with approximately 150 grams of machined molybdenum chips, which were used to create a molten pool of metal. The arc melting was conducted using approximately 4000 amperes of direct current, with the sintered electrode acting as the negative pole, at a chamber pressure of less than about 10 Pa (0.1 torr). The arc-melting produced ingots approximately 150 mm long and weighing about 11 kg.

Rhenium, tungsten, carbon and oxygen contents of the arc-cast ingots were determined, and the results are shown in Table 2. The oxygen content of the first two ingots (A1 and B2), was too great, and these ingots were not further analyzed or processed.

TABLE 2

COMPOSITIONS OF ARC-CAST INGOTS

| Electrode Number | Ingot Number | Rhenium wt. % | Tungsten wt. % | Carbon ppm | Oxygen ppm |
|---|---|---|---|---|---|
| A | A1 | — | — | — | 54 |
| B | B2 | — | — | — | 51 |
| C | C3 | 12.9 | — | 108 | 16 |
| D | D4 | 13.0 | 9.5 | 120 | 26 |
| E | E5 | 12.6 | — | 64 | 12 |
| F | F6 | 12.6 | 9.6 | 60 | 8 |

The four ingots which were analyzed (i.e., C3 through F6), were machined to about 80 mm diameter in preparation for extrusion and to remove surface roughness. The shrinkage cavity portion at the upper end of each ingot due to the arc-casting process was removed, and defect free extrusion billets approximately 125 mm long were obtained. The billets were machined to have an approximately 13 mm radius on the nose for extrusion.

The billets were preheated for about 1 hour at about 1370° C. in dry hydrogen prior to extrusion, and then extruded to form a bar, measuring approximately 25×51 mm rectangular bar, using a zirconia-coated steel die and Fiske 604 as a lubricant. It was observed that the alloys containing tungsten and/or a greater carbon content required larger loads for extrusion. The extrusion constant, K, which is a measure of the resistance of a material to deformation, ranged from about 625 to 725 MPa (45.8 to 52.5 tsi) during extrusion.

The extruded bars were rolled twice immediately after extrusion (i.e., while the bars were still red-hot), and then air-cooled to room temperature in order to obtain a sheet having a thickness of about 20 min. Surface defects of the bars were removed by grinding, and each bar was cut in half to form a rolling blank.

The rolling blanks were preheated to about 935° C., and rolled into a sheet approximately 3.6 mm thick. One half of the 3.6 mm sheets was further rolled to a thickness of approximately 2.0 mm. Subsequently, each of the 2.0 mm thick sheets was cut in half, and one half of each sheet was rolled into a thickness of about 1.4 mm. The later formed sheets were finish rolled. The surface oxides on the rolled sheets were removed in a caustic bath. The finished sheets were stress relieved by heating at about 880° C. for about 2 hours.

The carbon, oxygen and tungsten content of the rolled sheet product was determined from the 3.6 mm thick sheet of each alloy, and the results are summarized below in Table 3. The rhenium content in the rolled sheets is expected to be substantially equivalent to the corresponding arc-cast ingot.

TABLE 3

TUNGSTEN, CARBON AND OXYGEN CONTENT OF THE ROLLED SHEETS

| Alloy Number | Ingot Number | Tungsten wt. % | Carbon ppm | Oxygen ppm |
|---|---|---|---|---|
| C | C3 | — | 85 | 16 |
| E | E5 | — | 57 | 19 |
| D | D4 | 9.5 | 100 | 30 |

TABLE 3-continued

| TUNGSTEN, CARBON AND OXYGEN CONTENT OF THE ROLLED SHEETS | | | | |
|---|---|---|---|---|
| Alloy Number | Ingot Number | Tungsten wt. % | Carbon ppm | Oxygen ppm |
| F | F6 | 9.4 | 63 | 25 |

Figure 1B:
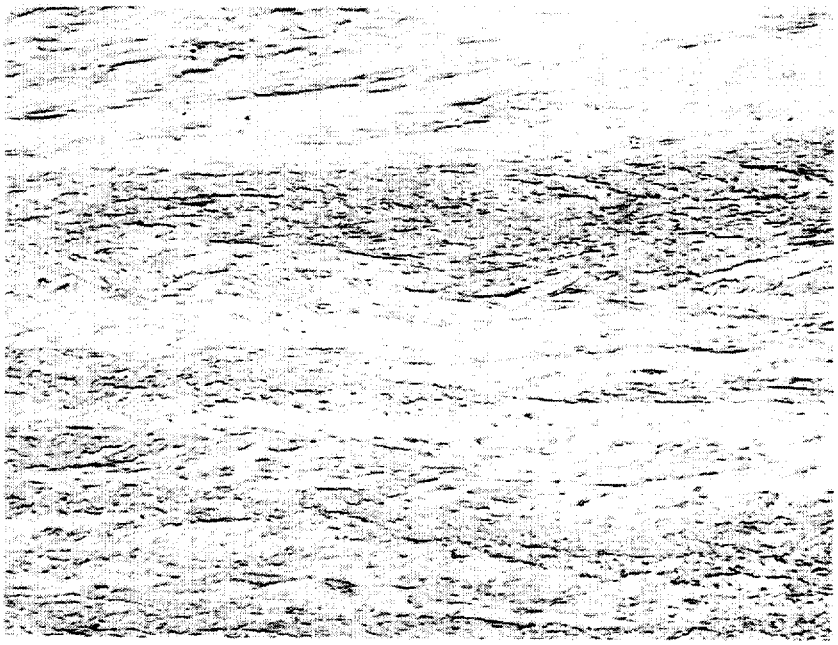
Figure 2A:
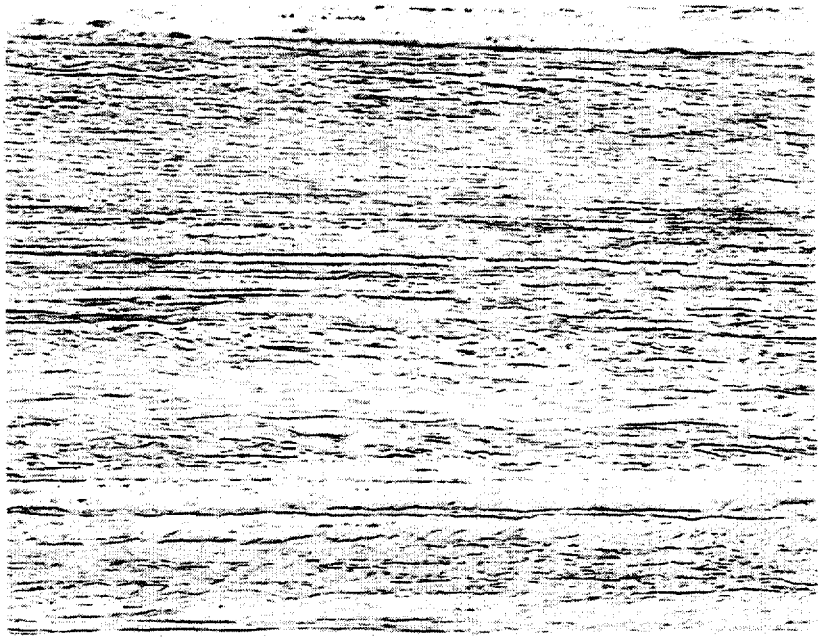
FIG. 2—FIGS. 2(*a*) and (*b*) are photo-micrographs at 200× magnification, respectively, along the longitudinal and transverse directions of a rolled Mo-13% Re-low C alloy sheet produced in accordance with the Example.
Figure 2B:
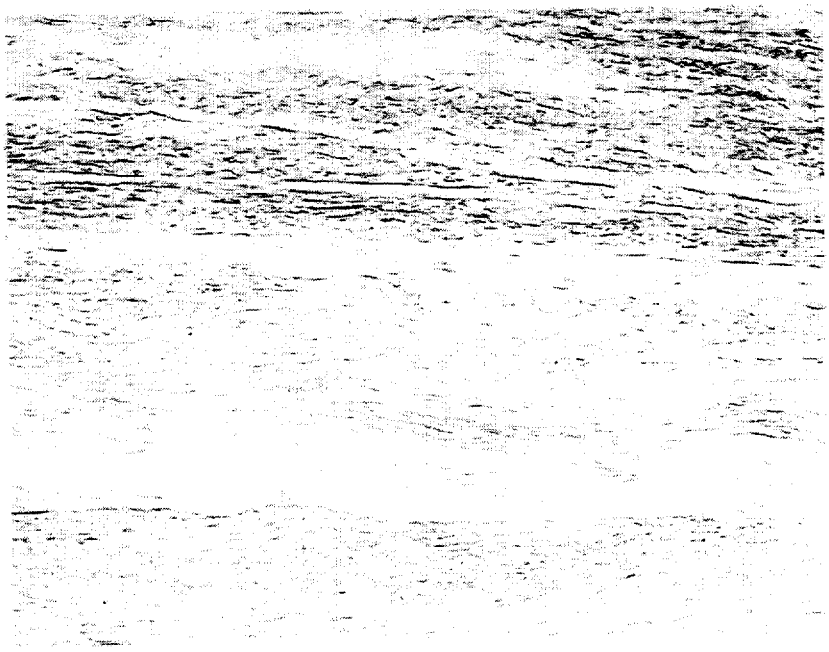
Figure 3A:
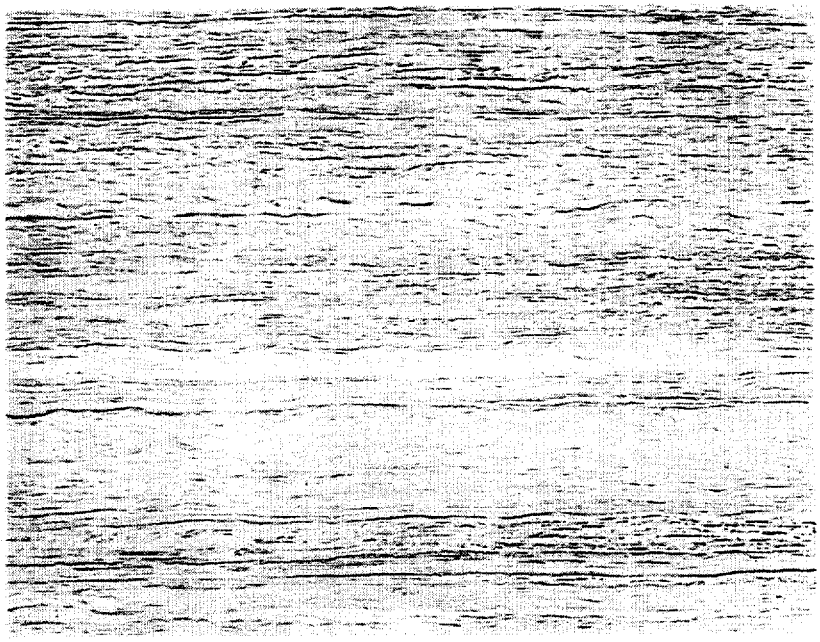
FIG. 3—FIGS. 3(*a*) and (*b*) are photo-micrographs at 200× magnification, respectively, along the longitudinal and transverse directions of a rolled Mo-13% Re-10% W-high C alloy sheet produced in accordance with the Example.
Figure 3B:
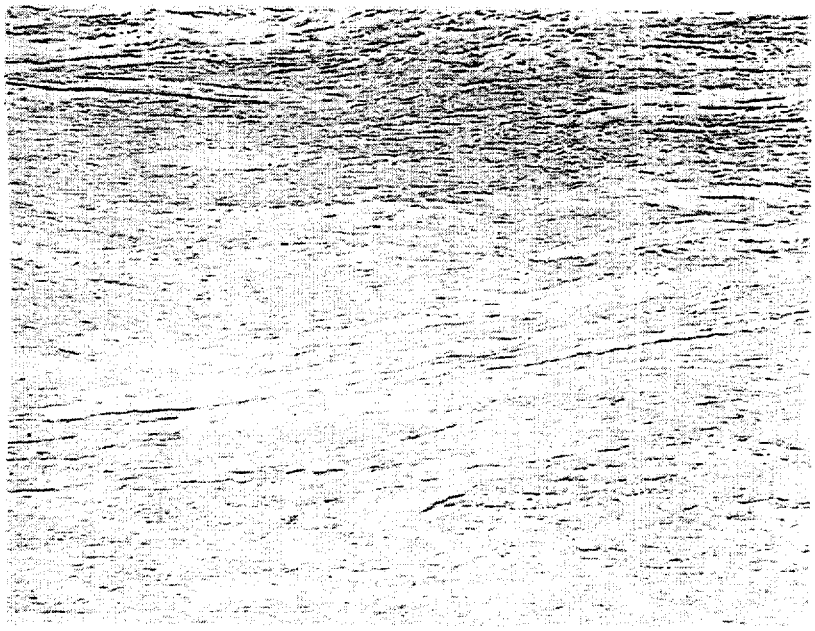
Figure 4A:
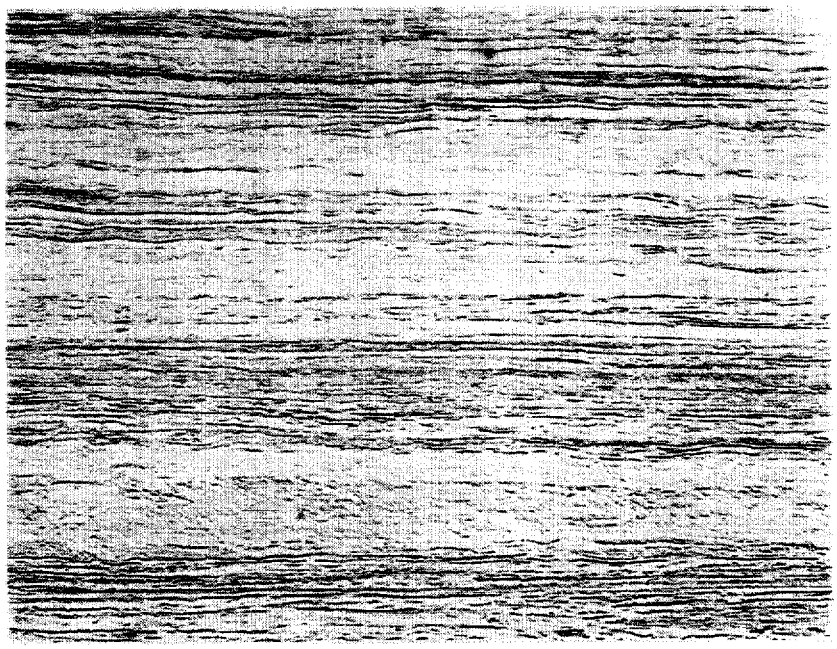
FIG. 4—FIGS. 4(*a*) and (*b*) are photo-micrographs at 200× magnification, respectively, along the longitudinal and transverse directions of a rolled Mo-13% Re-10% W-low C alloy sheet produced in accordance with the Example.
Figure 4B:
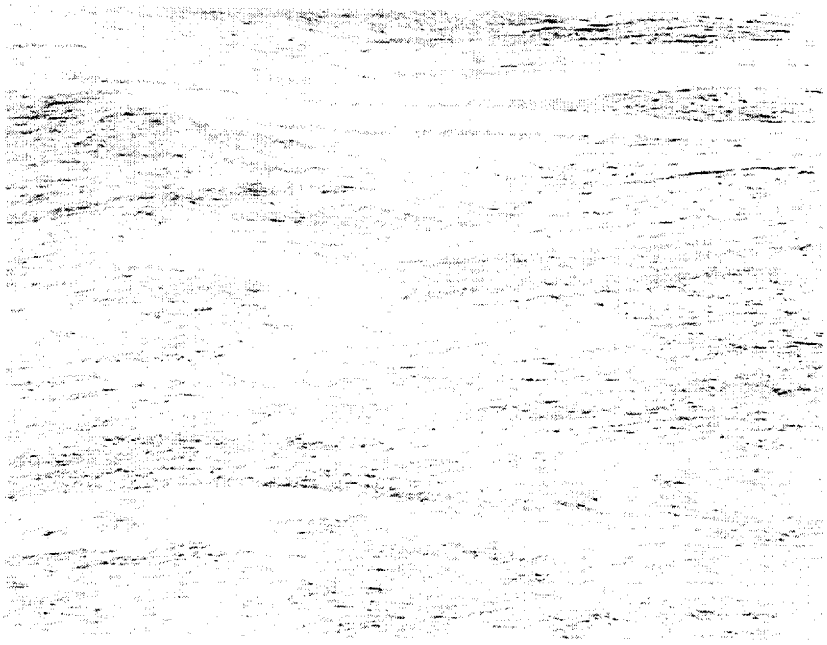

Metallographic specimens were obtained from the 1.4 mm sheets by cutting parallel (longitudinal), and perpendicular (transverse), to the rolling direction. Each specimen was mounted, mechanically polished, buffed in a potassium cyanide solution and etched with a modified Murakami's reagent and examined with an optical microscope. FIGS. 1(*a*) through 4(*b*) are photo-micrographs at 200× magnification of the longitudinal and transverse rolling directions, respectively, for sheets fabricated from alloys C through F. These figures illustrate that the alloy sheets have thin elongated grains along the rolling direction. Further, these figures show that the alloy is ductile and can be drawn without significant recrystallization.

Two tensile strength test specimens having a gauge section of approximately 6.3 mm wide and 25.4 mm long were prepared along the rolling (longitudinal) direction of each material. The tensile tests were conducted substantially in accordance with ASTM Procedure No. E8, at room temperature using strain rates of about $8.3\times10^{-5}$/sec and $8.3\times10^{4}$/sec, respectively, for the elastic and plastic regions. The results of the tensile strength test are shown below in Table 4.

TABLE 4

| ROOM TEMPERATURE TENSILE PROPERTIES OF THE ROLLED SHEETS | | | | | | |
|---|---|---|---|---|---|---|
| Alloy Number | Alloy | Nominal Thickness (inches) | 0.2% Y.S. (ksi) | U.T.S. (ksi) | El. (%) | R.A. (%) |
| C | Mo-13% Re | 0.140 | 115.6 | 134.5 | 17.1 | 24.8 |
| | -High C | 0.080 | 119.0 | 135.9 | 15.1 | 24.8 |
| | | 0.055 | 124.3 | 139.7 | 16.3 | 26.1 |
| E | Mo-13% Re | 0.140 | 111.6 | 129.5 | 19.7 | 26.8 |
| | -Low C | 0.080 | 120.7 | 137.5 | 16.8 | 29.6 |
| | | 0.055 | 122.0 | 136.2 | 15.1 | 20.7 |
| D | Mo-13% Re- | 0.140 | 137.0 | 150.1 | 17.9 | 23.7 |
| | 10% W | 0.080 | 137.9 | 149.8 | 15.5 | 22.8 |
| | High C | 0.055 | 139.1 | 149.4 | 16.7 | 22.3 |
| F | Mo-13% Re- | 0.140 | 135.9 | 148.2 | 15.8 | 20.0 |
| | 10% W | 0.080 | 136.3 | 149.4 | 14.8 | 18.3 |
| | Low C | 0.055 | 142.6 | 157.3 | 14.6 | 19.8 |

Y.S. = Yield Strength
U.T.S = Ultimate Tensile Strength
El. = Elongation
R.A. = Reduction in Area A review of Table 4 illustrates that an addition of about 10% tungsten to the Mo-13% Re alloy increased the tensile strength by about 10% without deteriorating the ductility. There was no significant difference in tensile properties between the high and low carbon version of each alloy.

In order to study the effect of the tungsten addition on the recrystallization behavior of the molybdenum-rhenium alloy, the recrystallization temperatures of Alloys C and D were determined. Small samples were cut along the rolling direction of the approximately 2 mm thick sheet of each alloy and annealed in hydrogen for about 1 hour at temperatures between about 1000° and 1400° C. The annealed samples were then sectioned and prepared for metallography (the appearance of the microstructures used for metallography was similar to the Figures discussed above and, therefore, have not been included).

The Vickers Hardness (HV) of each sample was determined substantially in accordance with ASTM Procedure No. E92, using a 1 Kg load. Visual estimates of percent recrystallization were made from the metallographic specimens. The results are summarized below in Table 5.

TABLE 5

| RESULTS OF RECRYSTALLIZATTON STUDY | | | | |
|---|---|---|---|---|
| Alloy: | Mo-13% Re-High C | | Mo-13% Re-10% W-High C | |
| Temp. °C. | Vickers Hardness | % Recrystallized | Vickers Hardness | % Recrystallized |
| 1000 | 313 | 0 | 314 | 0 |
| 1100 | 281 | 0 | 296 | 0 |
| 1150 | 218 | 50 | — | — |
| 1200 | 185 | 100 | 270 | 10 |
| 1250 | — | — | 230 | 75 |
| 1300 | 178 | 100 | 197 | 100 |
| 1400 | 179 | 100 | 198 | 100 |

In view of the above data, the 50% recrystallization temperature of the Mo-13% Re-high C alloy is estimated to be about 1150° C. and that of the Mo-13% Re-10% W-high C alloy is estimated to be about 1230° C. (i.e., the addition of 10% tungsten increased the recrystallization temperature of the alloy by about 80° C.).

A Charpy impact test was performed on twelve specimens obtained from a 3.6 mm sheet of the Mo-13% Re-high C alloy discussed above. Six specimens were machined along the longitudinal direction of the sheet and the remaining six specimens were from the transverse direction. Each specimen was about 3.2 mm thick, about 55 mm wide and about 10 mm long. An approximately 2 mm deep 45 degree V-Notch was cut into each specimen. Duplicate Charpy impact tests were conducted at −18° C., 22° C. and 149° C., substantially in accordance with ASTM Procedure No E-23. The results of the Charpy impact test are listed in Table 6.

TABLE 6

| TEMPERATURE (°C.) | DIRECTION | IMPACT (ft-lbs.) | ENERGY (Joules) |
|---|---|---|---|
| −18 | longitudinal | 0.9 | 1.22 |
| — | transverse | 0.8 | 1.08 |
| 22 | longitudinal | 1.3 | 1.76 |
| — | transverse | 1.3 | 1.76 |
| 149 | longitudinal | 5.1 | 6.91 |
| — | transverse | 2.9 | 3.93 |

While certain aspects of the invention have been described above in detail, an artisan in this art will recognize that other embodiments and variations are encompassed by the appended claims.

What is claimed is:

1. An unrecrystallized alloy consisting essentially of molybdenum, rhenium and tungsten having a composition of about 10 to 45 weight % of rhenium, about 10 to 20 weight % tungsten, at least about 50 ppm of a deoxidant with the remainder molybdenum, wherein said alloy has a tensile strength of at least about 129 ksi and a recrystallization temperature of at least about 1150° C.

2. An unrecrystallized alloy for use in fabricating chemical processing equipment consisting essentially of about 12.5 to 13.5% by weight of rhenium, about 9 to 11% by weight tungsten, at least about 50 to 100 ppm carbon, with the remainder molybdenum, wherein said alloy has a tensile strength of at least about 148 ksi and a recrystallization temperature of at least about 1230° C.

3. An unrecrystallized alloy consisting essentially of: molybdenum, from about 10 through about 41 weight percent rhenium at least about 50 ppm of a deoxidant, and; an amount of tungsten that is sufficient to increase the recrystallization temperature of said ternary alloy relative to a binary molybdenum-rhenium alloy wherein said alloy has a tensile strength of at least about 129 ksi and a recrystallization temperature of at least about 1230° C.

4. The ternary alloy of claim 3, wherein said deoxidant comprises carbon.

5. The alloy of claim 3 wherein said amount of tungsten ranges from about 10 through about 20 wt. %.

6. The alloy of claim 1 wherein said deoxidant is carbon.

7. An unrecrystallized alloy consisting essentially of about 41 to 45 weight percent rhenium, about 10 to 20 weight percent tungsten, at least about 50 ppm carbon, and the remainder molybdenum; wherein said alloy has a tensile strength of at least about 129 ksi and a recrystallization temperature of at least about 1150° C.

* * * * *